United States Patent [19]

Hashimoto et al.

[11] Patent Number: 4,629,173

[45] Date of Patent: Dec. 16, 1986

[54] SHEET REVERSE APPARATUS

[75] Inventors: Kiyoshi Hashimoto, Yokohama; Mitsuo Yamashita, Tokyo; Kiyoshi Tomimori, Yokohama; Shinji Nakagawa, Tokyo, all of Japan

[73] Assignee: Kabushiki Kaisha Toshiba, Kawasaki, Japan

[21] Appl. No.: 795,548

[22] Filed: Nov. 6, 1985

[30] Foreign Application Priority Data

Nov. 13, 1984 [JP] Japan ..... 59-239638

[51] Int. Cl.[4] ..... B65H 29/22

[52] U.S. Cl. ..... 271/65; 271/186; 271/291; 355/3 SH; 355/14 SH; 355/24

[58] Field of Search ..... 271/186, 291, 65, 290; 355/3 SH, 14 SH, 24

[56] References Cited

U.S. PATENT DOCUMENTS

| | | | |
|---|---|---|---|
| 3,856,295 | 12/1974 | Looney | 271/65 |
| 4,078,789 | 3/1978 | Kittredge | 271/186 X |
| 4,534,643 | 8/1985 | Watanabe | 271/186 X |
| 4,579,446 | 4/1986 | Fujino | 271/186 X |

FOREIGN PATENT DOCUMENTS

| | | |
|---|---|---|
| 52-97744 | 8/1977 | Japan . |
| 53-118530 | 9/1978 | Japan . |
| 53-150228 | 11/1978 | Japan . |

*Primary Examiner*—Richard A. Schacher

*Attorney, Agent, or Firm*—Schwartz, Jeffery, Schwaab, Mack, Blumenthal & Evans

[57] ABSTRACT

A sheet reverse apparatus for reversing a paper sheet discharged from an image forming apparatus has a mounting mechanism fixed to the image forming apparatus, and a power transmission mechanism. The power transmission mechanism is engaged with an output gear coupled to a drive source of the image forming apparatus, and transmits a driving force from the image forming apparatus to an input gear. The power transmission mechanism has a swingable plate and a spring for biasing the swingable plate in one direction. A movable gear meshed with the input gear and rotatable therearound is axially supported on the swingable plate. When the sheet reverse apparatus is mounted on the image forming apparatus, driving power from the sheet reverse apparatus can be supplied from the image forming apparatus through the input gear and the power transmission mechanism.

16 Claims, 22 Drawing Figures

SHEET REVERSE APPARATUS

BACKGROUND OF THE INVENTION

The present invention relates to a sheet reverse apparatus for reversing the surface of a paper sheet on which an image is formed by an image forming apparatus.

In general, in an image forming apparatus such as a copying machine, an electronic printer and the like, an image is formed on one surface of a paper sheet supplied from a paper feed cassette, and the sheet is discharged onto an outlet tray.

In an image forming apparatus of this type, sheets discharged onto an outlet tray are sequentially stacked such that their image surfaces face upward. Therefore, when a sheet is discharged, an operator can immediately and visually check the image formed on it. Unfortunately, however, in so far as the sheets are sequentially stacked in an order opposite the copying order, with the first page being at the bottom and the last page being at the top, it is necessary for the operator to restack the sheets in accordance with the copying or pagination order, a cumbersome task at the best of times, but made even more so as the number of pages increases. For this reason, in place of an outlet tray, a sheet reverse apparatus for reversing and stacking discharged sheets is mounted on the outlet side of the image forming apparatus.

A conventional sheet reverse apparatus incorporates a drive source for driving motors required for a reverse operation, and an exit roller. Due to the presence of the drive source, the overall sheet reverse apparatus becomes large in size and heavy in weight.

In order to solve the above problem, a method has been proposed wherein the drive source is omitted, the drive force required for driving rollers for the reversal of a sheet being supplied from the image forming apparatus. However, in this case, in order to precisely mesh the output gear of the image forming apparatus with the input gear of the sheet reverse apparatus, alignment and machining of these gears requires considerable precision, resulting in high cost.

SUMMARY OF THE INVENTION

The present invention has been devised in consideration of the above situation, and has as its object to provide a compact, lightweight, and inexpensive sheet reverse apparatus.

According to an aspect of the present invention, there is provided a sheet reverse apparatus for reversing the image surface of a sheet discharged from an image forming apparatus having an output gear of a drive system, comprising mounting means for mounting said sheet reverse apparatus to said image forming apparatus, an input gear for receiving driving power, driving force transmission means which meshes with said output gear when said sheet reverse apparatus is mounted to said image forming apparatus to transmit a rotational force from said output gear to said input gear, said driving force transmission means having one end pivotally supported at a rotating center of said input gear and including a swingable plate swingable around the rotating center, and the driving force transmission means itself serving to pivotally support, at its other end, a movable gear which is meshed with an rotatable around said input gear; and spring means for biasing said swingable plate toward said output gear so as to mesh said movable gear with said output gear.

DETAILED DESCRIPTION OF THE PREFERRED EMBODIMENTS

Embodiments of the present invention will be described with reference to FIGS. 1 to 22.

Figure 1:
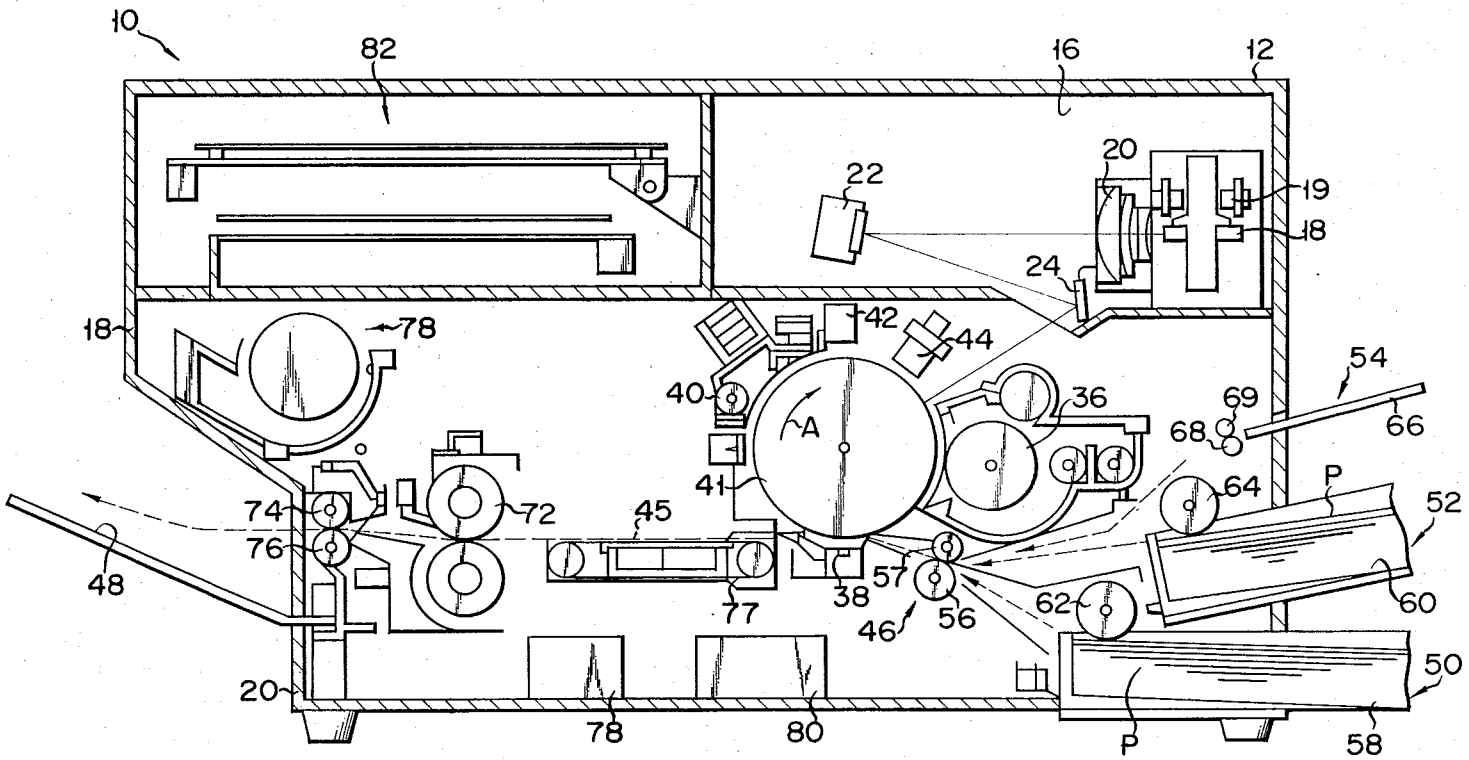
FIG. 1 is a schematic, sectional view of the laser beam printer used in an embodiment of the present invention.

FIG. 1 shows the laser beam printer 10 used in an embodiment of the present invention. A photosensitive body 14 is rotatably supported in the central portion of the interior of the body 12 so that an electrostatic latent image is formed on the surface of the photosensitive body 14 by a laser beam applied thereto. A laser scanner unit 16 for converting video data received from a data control unit (not shown) into a laser beam so as to irradiate the body 14 therewith is provided above the body 14. The unit 16 comprises a polygonal mirror 18 for guiding a laser beam from a laser diode (not shown, but used to convert video data into a laser beam) onto the body 14, a scan motor 19 for rotating the polygonal mirror 18 at a high speed, and an f.θ lens 20 for averaging the scanning speed of a laser beam on the body 14. Reference numerals 22 and 24 denote reflection mirrors for guiding a laser beam from the unit 16 to the body 14.

Adjacent to the photosensitive body 14 is a developing device 36 for developing an electrostatic latent image formed on the photosensitive body 14 by applying a toner to the image, and a transfer device 38 for transferring the toner image on the surface of the photosensitive body 14 to the copying paper P. Also adjacent to the photosensitive body 14 is a cleaning device 40 for removing the toner on the photosensitive body 14, a deelectrifier 42 for removing the electrostatic latent image on the photosensitive body 14, and a charger 44.

The starting end of a transfer path 45 (shown as a broken line in FIG. 1) is coupled to a sheet feeder (sheet feeding unit) 46, while the extreme end of the transfer path 45 extends to an outlet tray 48 which receives discharged copies. The outlet tray 48 is removably attached.

The sheet feeder 46 comprises a first cassette loading section 50, a second cassette loading section 52, a manual inserting section 54, and a pair of aligning rollers 56 and 57 for lining up copying paper sheets fed from any one of these sections. The first cassette loading section 50 is fitted with a first cassette 58 which stores copying paper sheets of one size, and the second cassette loading section 52 is fitted with a second cassette 60 which stores copying paper shets of another size. The paper sheets are delivered selectively from the cassette 58 or 60. The first cassette loading section 50 includes a first paper-supply roller 62 for feeding the paper sheets toward the aligning rollers 56 and 57. Likewise, the second cassette loading section 52 includes a second paper-supply roller 64. The manual inserting section 54 is provided with a guide tray 66 and a pair of feed rollers 68 and 69 for feeding the paper sheet inserted along the guide tray 66 toward the aligning rollers 56.

A fixing device 72, for fixing the toner to the paper sheet, and exit rollers 74 and 76 are arranged near the extreme end of the transfer path 45. A cooling fan unit 78 is disposed over the exit rollers 74 and 76. Reference numeral 77 denotes a conveyor belt for conveying the sheets from the transfer device 38 to the fixing device 72.

Referring to FIG. 1, reference numeral 78 denotes a high voltage transformer for applying a high voltage to the charger 44, the transfer device 38, the deelectrifier 42 and the developing device 36; 80, a power source unit for generating a DC voltage used for controlling respective components; and 82, a PC board unit for controlling the printer 10.

The operation of the laser beam printer 10 will be described hereinafter. The photosensitive body 14 is driven by a drive mechanism (not shown) in the direction indicated by arrow A, and is uniformly charged by the charger 44. The laser scanner unit 16 is driven based upon the video data supplied from the data control unit (not shown), and a laser beam is focused on the body 14 through the reflection mirrors 22 and 24, thereby forming a latent image thereon. The latent image formed on the body 14 is developed by the developing device 36 so as to form a toner image, and is fed to the transfer device 38. On the other hand, a sheet fed automatically or manually is conveyed by the rollers 56 and 57 in synchronism with the body 14, and the toner image formed on the body 14 in advance is transferred onto the paper by the transfer device 38. After the sheet is peeled from the photosensitive body 14 it is guided to the fixing device 72, and the transferred image is fixed on the sheet. Thereafter, the sheet is discharged onto the outlet tray 48 or outside of the apparatus by the exit rollers 74 and 76. In this case, the sheet is discharged so that the image surface faces upward. Meanwhile, residual toner on the photosensitive body 14 is cleaned by the device 40, and an after image on the photosensitive body 14 is erased by the deelectrifier 42 in preparation for the next printing operation.

Figure 2:
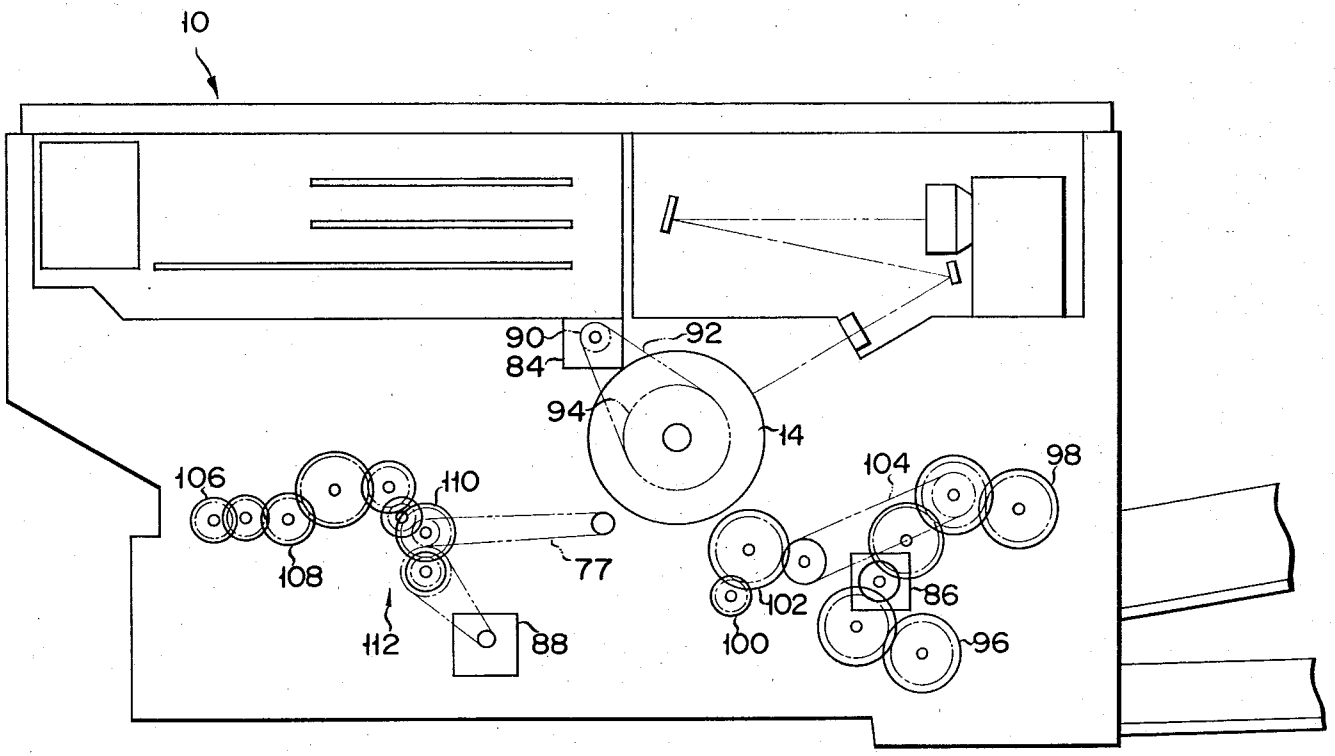
FIG. 2 is a schematic, sectional view of the drive mechanism of the laser beam printer shown in FIG. 1.

The drive mechanism of the laser beam printer 10 will be described with reference to FIG. 2. Three motors 84, 86 and 88 are disposed on one side of the photosensitive body 12. The drive shaft 90 of the first motor 84 is coupled to the shaft 94 of the photosensitive body 14 through a belt 92 so as to drive the photosensitive body 14. The second motor 86 is used to drive the sheet feeder, and is driven in synchronism with the first motor 84. The motor 86 is coupled, through a gear array 102 and a belt 104, to a gear 96 fixed to the shaft of the roller 62, a gear 98 fixed to the shaft of the roller 64 and a gear 100 fixed to the shaft of the roller 56.

The third motor 88 is meshed, through a gear array 112 serving as a power transmission mechanism, with an output gear 106 fixed to the shaft of the rollers 74, a gear 108 fixed to the shaft of the roller 72 and a gear 110 for driving the belt 77 (shown in FIG. 1). The output gear 106 is threaded with the input gear 116 (to be described later) of a sheet reverse apparatus 114 (to be described later), and serves to transmit a rotating force to the input gear 116.

The schematic structure of the sheet reverse apparatus 114 according to an embodiment of the present invention will be described with reference to FIG. 3.

The sheet reverse apparatus 114 is detachably mounted at the paper outlet side of the printer 10 from which the outlet tray 48 has been removed. The sheet reverse apparatus 114 comprises a first guide plate 120 for guiding the sheet discharged from the exit rollers 74 and 76 into the body 118. The plate 120 extends to the side of the printer 10 from the apparatus 114. A first conveyor path (arrow A) for reversing the sheet guided by the plate 120, and a second conveyor path (arrow B) for conveying the sheet guided by the plate 120 such that the image surface faces upward, are provided at the proximal end of the plate 120. A gate 124 is supported to be swingable about a shaft 122 at the proximal end of the guide plate 120, so that the sheet conveyed from the plate 120 can be selectively fed to the path A or B. Second and third guide plates 126 and 128 are arranged as to sandwich the guide plate 124.

Figure 3:
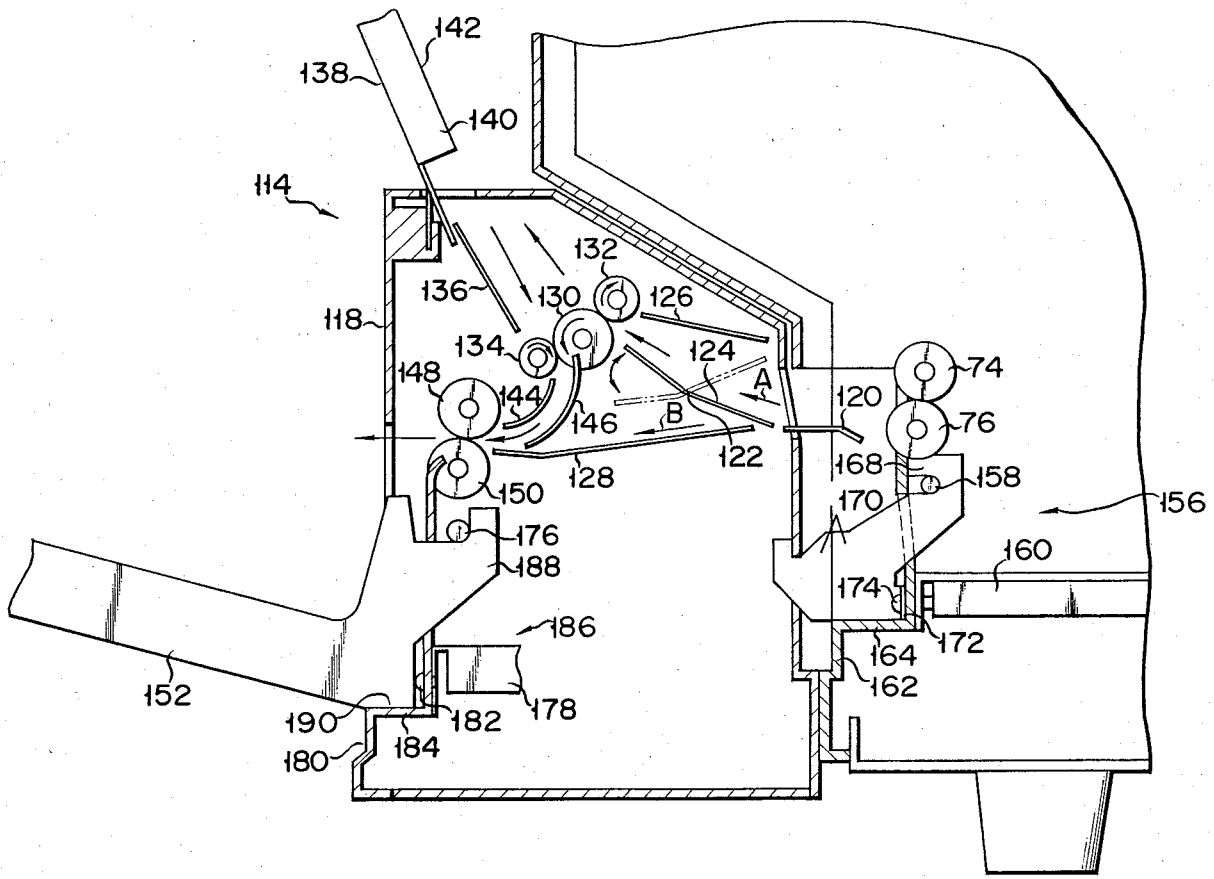
FIG. 3 is a schematic, sectional view of the sheet reverse apparatus according to the embodiment of the present invention.

When the gate 124 is set to the position indicated by the solid line in FIG. 3, the path A is formed between the upper surface of the gate 124 and the second guide plate 126. When the gate 124 is set to the position indicated by the one dot chain line, the path B is formed between the lower surface of the gate 124 and the third guide plate 128. Note that the gate 124 can be selectively operated, by an operator, by means of a lever (to be described later). A driving roller 130, a first driven roller 132 rotatably engaged with the roller 130, and a second driven roller 134 rotatably engaged with the roller 130 at a position facing the roller 132 are provided along the path A. An inclined fourth guide plate 136, made of glass, is provided above the roller 134, and an intermediate tray 138, detachable to the body 118 of the apparatus 114, is provided above and substantially along an extending line of the plate 136. The rollers 132 and 134 are biased against the roller 130 and clamp the sheet therebetween by the rotating force of the roller 130 so as to frictionally convey the sheet. A cover 140 is mounted on the tray 138 so as to shield the sheet from wind produced by the fan 78 (FIG. 1). A portion of the upper surface 142 of the cover 140 is made of a transparent material and an operator can visually observe the image surface of the sheet from the direction indicated by the arrow in FIG. 3. Fifth and sixth arcuated guide plates 144 and 146 are arranged at the sheet conveying side by the rollers 130 and 134, and guide the sheet reversed by the tray 138 to exit rollers 148 and 150. An outlet tray 152 for receiving the discharged sheet from the outlet side of the rollers 148 and 150 is mounted thereat.

A reverse convey operation by means of the first conveyor path A, and a normal convey operation by means of the second conveyor path B will be described hereinafter. First, the reverse convey operation will be described. A sheet is fed from the rollers 74 and 76 of the printer 10, and a leading end of the sheet is guided into the apparatus 114 by the first guide plate 120. In this case, the gate 124 is set at the position indicated by the solid line in FIG. 3. Therefore, the sheet P from the plate 120 is conveyed along the path A. In the path A, the sheet P is guided to the gate 124 and abuts against the nip portion of the rollers 130 and 132. Then, the sheet is clamped and conveyed by the rollers 130 and 132, and is fed obliquely upward onto the tray 138. Note that the feed angle is restricted by a flexible guide 154 (shown in FIG. 6) mounted on the second guide plate 126, and that the front edge of the sheet abuts against the tray 138 at a slight angel. Thereafter, the sheet is fed along the sheet receiving surface of the tray 138. The image surface of the sheet in the tray 138 can be visually observed through the transparent upper surface 142 of the cover 140, and whether or not an image is correctly formed can be checked. When the rear edge of the sheet is fed by the rollers 130 and 132, the rear edge of the sheet is moved around the circumference of the roller 130 by the rotating force of the roller 130 and the sheet weight, and abuts against the nip portion of the rollers 130 and 134. (Note that the plate 136 guides the sheet so as to abut it against the nip portion.) This being the case, the rear edge of the sheet is directed forward such that the sheet is reversed. Thereafter, the reversed sheet is clamped and conveyed by the rollers 130 and 134, and is conveyed through the plates 144 and 146 and the rollers 148 and 150. That is, the sheet is conveyed such that its front edge and its rear edge are reversed, with, accordingly, the image surface of the sheet being reversed, i.e., the image surface faces downward.

The sheet on which an image is formed first is placed on the tray 152 so that its image surface faces downward, and all subsequent sheets are sequentially stacked on top of it in a like manenr. Therefore, when a paginated document is copied, the copied sheets can be sequentially stacked in the order of the page numbers. As a result, when the copies of the document are filed, the procedure for sorting the sheets in the order of pagination can be omitted. Note that if the sheet reverse apparatus 114 is used, the difficulty in supplying data from the last page to a data supply device for controlling the laser scanner unit 16 to allow easy filing of copies can be overcome.

The apparatus 114 can convey sheets in the same state as in the sheet convey state of the printer 10 by switching the gate 124. When the gate 124 is set to the position indicated by the one dot chain line in FIG. 3, the sheet fed from the rollers 74 and 76 of the printer 10 is guided to the rollers 148 and 150 along surfaces of the first and third guide plates 120 and 128, and is discharged onto the tray 152 with its image surface facing upward.

According to the sheet reverse apparatus 114 of the present invention, both the reverse and normal convey operations can be selectively performed without mounting/demounting the apparatus 114, resulting in highly improved operability.

The mounting mechanism 156 for mounting the apparatus 114 on the printer 10 will be explained hereinafter. An engaging shaft 158 is suspended below the rollers 74 and 76 at the sheet discharge side of the printer 10, and a frame plate 160 is disposed such that it engages shaft 158. A back surface cover 162 is detachably mounted on the plate 160 of the printer 10. The cover 162 has a horizontal stepped surface (horizontal surface) 164. A mounting unit 166 is constituted of the shaft 158 and the horizontal surface 164. A mounting metal member 170, as a mounted member having a hook portion 168 extending obliquely upward, is fixed on the side of the apparatus 114 against which the printer 10 abuts. The apparatus 114 can be mounted on the printer 10 in such a manner that the portion 168 of the member 170 is inserted obliquely upward with respect to the shaft 158 so as to be engaged with the shaft 158. Then, the entire apparatus 114 pivots counterclockwise about the shaft 158 by its weight, and the lower end of the member 170 then abuts against the surface 164. In this manner, the apparatus 114 can be mounted on the printer 10 by engaging the member 170, using the shaft 158 and the surface 164. In this embodiment, in order to secure the apparatus, bent portions 172 formed by horizontally extending two sides of the member 170 are tightly fixed to the frame 160 by screws 174.

The tray 152 is mounted on the apparatus 114 in the same manner as the apparatus 114 is mounted on the printer 10. An engaging shaft 176 is suspended below the rollers 148 and 150 of the apparatus 114, and a frame 178 is arranged therebelow. A back surface cover 180 is fixed to the frame 178 by a screw 182, and has a stepped surface (horizontal surface) 184. A mounting unit 186 is constituted of the shaft 176 and the surface 184. A hook portion 188, as a mounted member, and an engaging end face 190 are formed integrally with the tray 152. The portion 188 is engaged with the shaft 176, and the end face 190 is engaged with the surface 184, thereby detachably mounting the tray 152. In this manner, since the mounting unit 156 of the printer 10 has the same configuration as the mounting unit 186 of the apparatus 114, the apparatus 114, as an optional unit, can be easily mounted/demounted on/from the printer 10. Furthermore, the tray 152 can also be easily mounted on the unit 186 of the apparatus 114. If a sorter 296 for classifying and stacking copies in a given number of pages (to be described later) is provided with the same configuration as the hook portion 188 of the tray 152, it can be mounted on the apparatus in the same manner as described above. In this manner, when the hook portion 188 is formed on optional units, the units can be easily and compatibly mounted/demounted.

Figure 4:
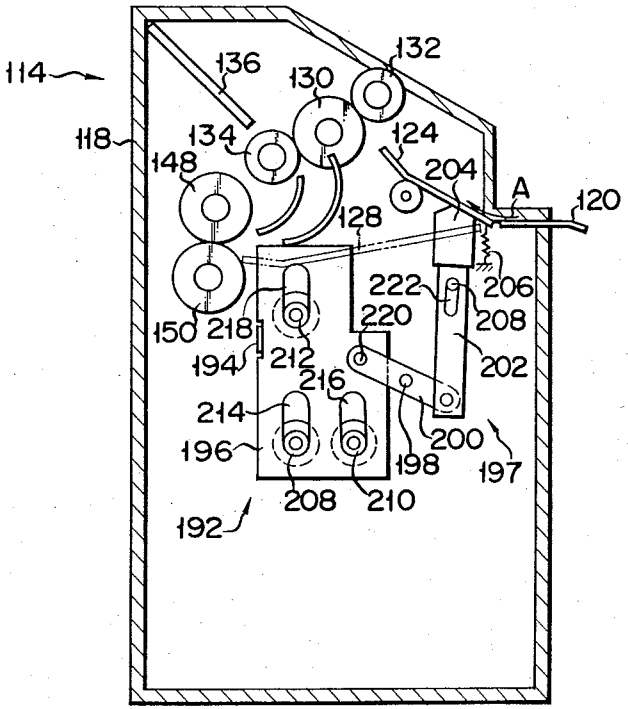

The drive means 192 for selectively driving the gate 124 will be described with reference to FIGS. 4 and 5. A slidable plate 196 having a lever 194 is provided to the drive means 192 for the gate 124 to be vertically slidable. A link mechanism 197 operated by vertical movement of the plate 196 is coupled thereto. In the mechanism 197, a first link 200 which is swingable about a fulcrum 198 in response to the sliding movement of the plate 196, a second link 202 which moves vertically in response to displacement of the link 200, a driving chip 204 fixed to an upper end of the link 202 and abutting against the lower surface of the gate 124, and a spring 206 for continuously biasing the distal end of the gate 124 downward are coupled. The lever 194 extends from an outer surface of the apparatus 114. Vertically elongated holes 214, 216 and 218, for receiving pins 208, 210 and 212, are formed in the plate 196 to which the lever 194 is fixed. The plate 196 is guided by the pins 208, 210 and 212 and is vertically moved by operating the lever 194. A pin 220 for axially supporting one end of the link 200 extends from the plate 196. Two ends of the plate 196 are supported by the plate 196 and an edge portion of the link 202, respectively, to be swingable about the fulcrum 198 by the sliding movement of the plate 196. An elongated hole 222 is formed in the link 202, and receives the pin 208.

In the drive means 192 with the above arrangement, the operation for driving the gate 124 will be explained hereinafter. When the sheet is to be guided along the first convey or path A, an operator moves the lever 194 upward so as to set the plate 196 in the position shown in FIG. 4. In this case, the link 200 is pivoted clockwise about the fulcrum 198 and moves the link 202 downward. As a result, since the chip 204 is located at the lower position, the gate 124 is set in a direction crossing the third guide plate 128, by the biasing force of the spring 206, as shown in FIG. 4. Therefore, the sheet is guided to the path A by the gate 124.

Figure 5:
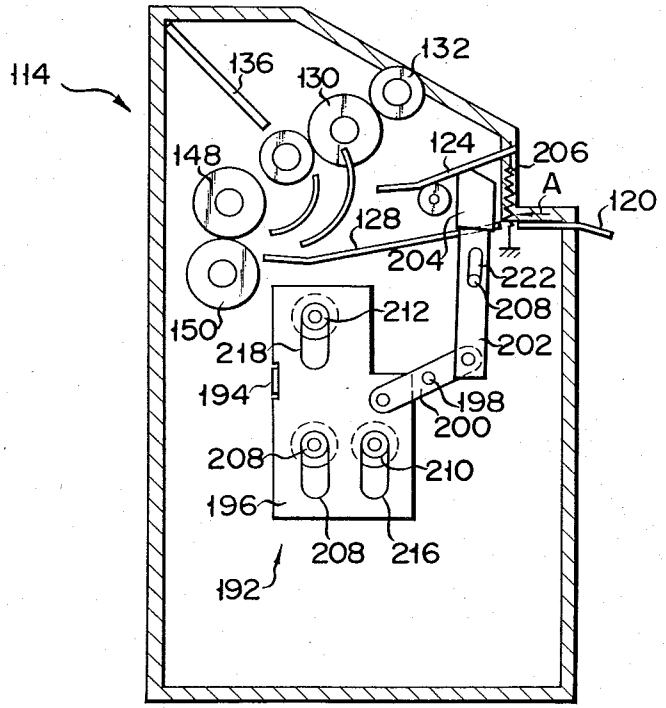
FIGS. 4 and 5 are schematic, sectional views of the gate driving mechanism of the sheet reverse apparatus shown in FIG. 3.

On the other hand, when the sheet is guided to the path B, the lever 194 is moved downward, and the plate 196 is set in the position shown in FIG. 5. In this case, the link 200 is pivoted counterclockwise about the fulcrum 198, thus moving the link 202 upward. Therefore, the chip 204 is set at the upper position, and the gate 124 abutting against the chip 204 is moved upward against the biasing force of the spring 206. As a result, the sheet is guided onto the plate 128, i.e., guided to the second conveyor path B.

According to the present invention, the position of the gate 124 for selectively guiding the sheet onto the paths A or B can be easily set by the lever 194 which extends outside the apparatus.

Figure 6:
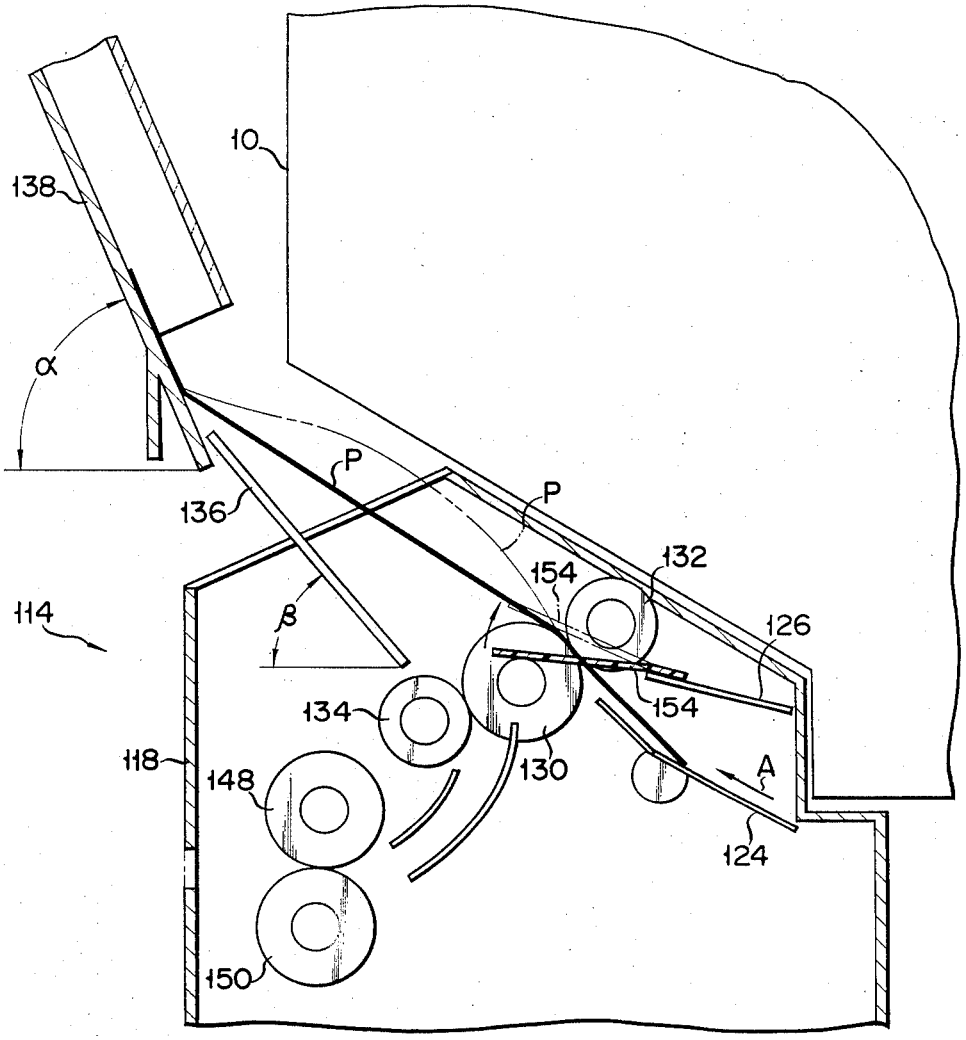
FIG. 6 is a schematic, sectional view of the conveyor path of the sheet reverse apparatus shown in FIG. 3.
Figure 7:
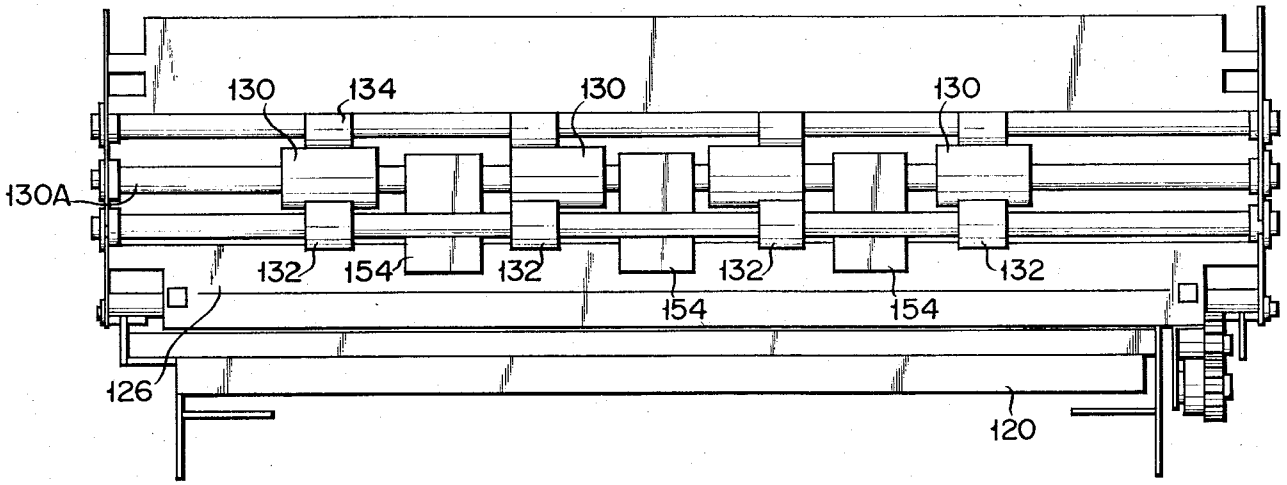
FIG. 7 is a plan view of an arrangement of a guide member for guiding sheets.

The flexible guide 154 provided along the path A for restricting the feed angle of the sheet by the rollers 130 and 132 will be explained with reference to FIGS. 6 to 8. As shown in FIGS. 6 and 7, the flexible guide 154 has one end engaged with the upper surface of the guide plate 126 and the other end crossing the path A, and extends between a nip portion of the rollers 130 and 132 and the plate 120. The guide 154 is disposed between the four driving rollers 130 and the four first driven rollers 132. The other end of the guide 154 is engaged with the rotating shaft 130A of the roller 130.

The operation of the flexible guide 154 will be described. The sheep P guided on the path A by the gate 124 abuts against the guide 154 (indicated by the solid line) formed to cross the path A, and the guide 154 is pushed upward by the force of the conveyed sheet P so as to be shifted to the position indicated by the one dot chain line in FIG. 6. The guide 154 presses on the upper surface of the sheet P conveyed by the rollers 130 and 132 by its flexibility (elastic force), thus restricting the feed angle of the sheet P. In this manner, the sheet P in contact with and pressed by the guide 154 is fed as indicated by the bold solid line in FIG. 6, and is fed into the intermediate tray 138 at a slight angle. As a result, the front edge of the sheet P abutting against the tray 138 is smoothly moved upward along the wall surface of the tray 138.

If the guide 154 is omitted, the sheet P is fed straight, first by its stiffness as indicated by a two dots chain line, gradually curved by its weight, and inserted into the tray 138 at a considerable angle with respect thereto. In this case, the sheet cannot be moved upward along the wall surface of the tray 138, thus causing a paper jam. According to this embodiment, since the feed angle of the sheet is restricted by the guide 154, the sheet P can be smoothly conveyed by the tray 138 and paper jam can be prevented.

Note that the guide 154 can be of any flexible material, e.g., a Mylar member or a metal thin plate. Furthermore, when an electric charge on the sheet is discharged, the sheet can be smoothly moved in the tray 138. In this case, the guide 154 is formed by a metal. Alternatively, for discharging an electric charge on the sheet, a metal brush can be added to the guide 154 to facilitate discharge of the electric charge on the sheet.

Figure 8:
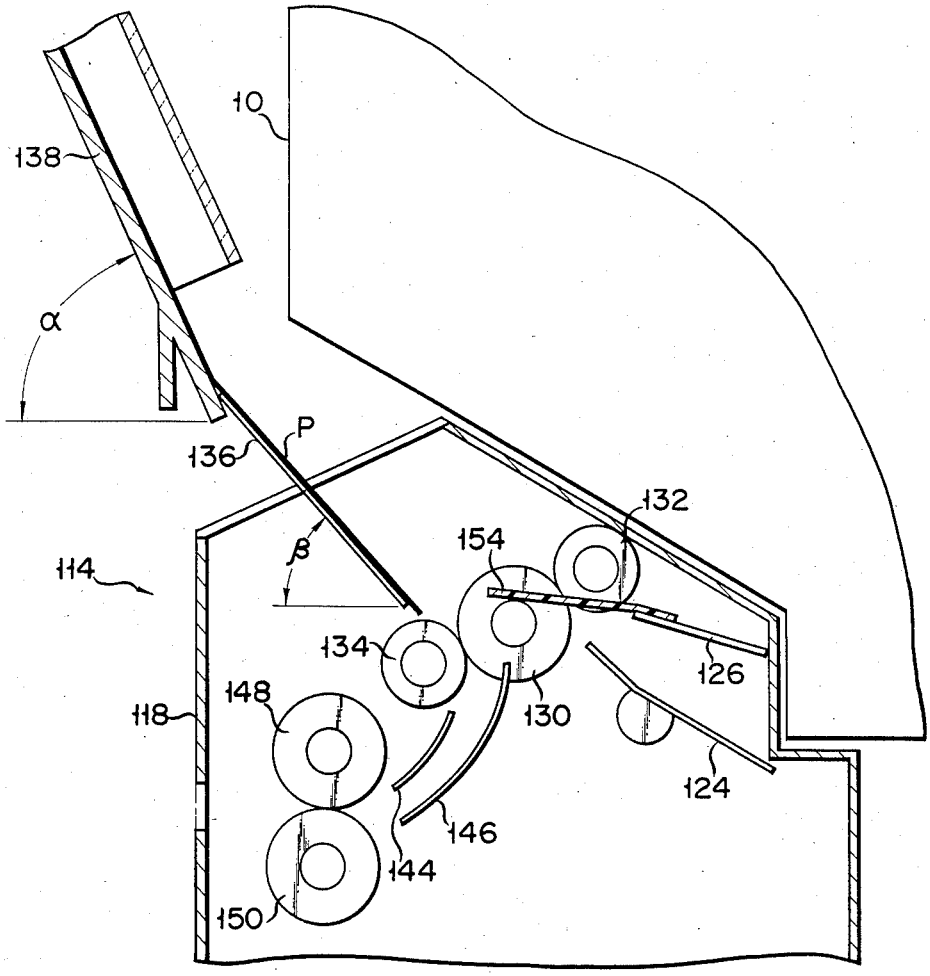
FIG. 8 is a partial, schematic, sectional view explaining the operation of reversing sheets by means of the sheet reverse apparatus shown in FIG. 3.

Angles of the tray 138 and the guide plate 136 with respect to the horizontal plane are set at $\alpha$ and $\beta$, as shown in FIGS. 6 and 8. In this embodiment, the angle $\beta$ is set at about 66°, and the angle $\beta$ is set at about 48°. Since the sheet P is guided to the nip portion of the rollers 130 and 132 by its weight, the angle $\beta$ of the guide plate 136 is preferably set at about 45° or more so that the sheet can be smoothly dropped by its weight.

Figure 9:
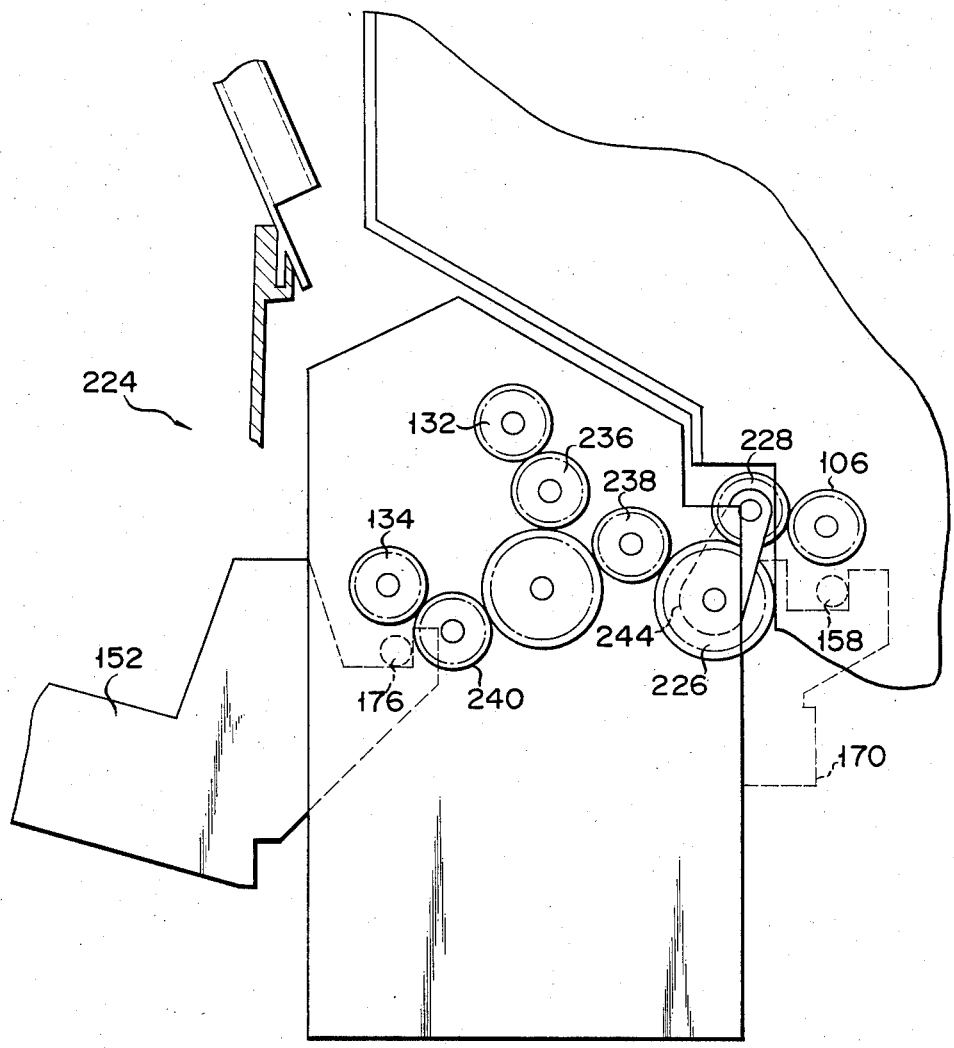
FIG. 9 is a schematic, sectional view of the drive mechanism of the sheet reverse apparatus shown in FIG. 3.
Figure 10:
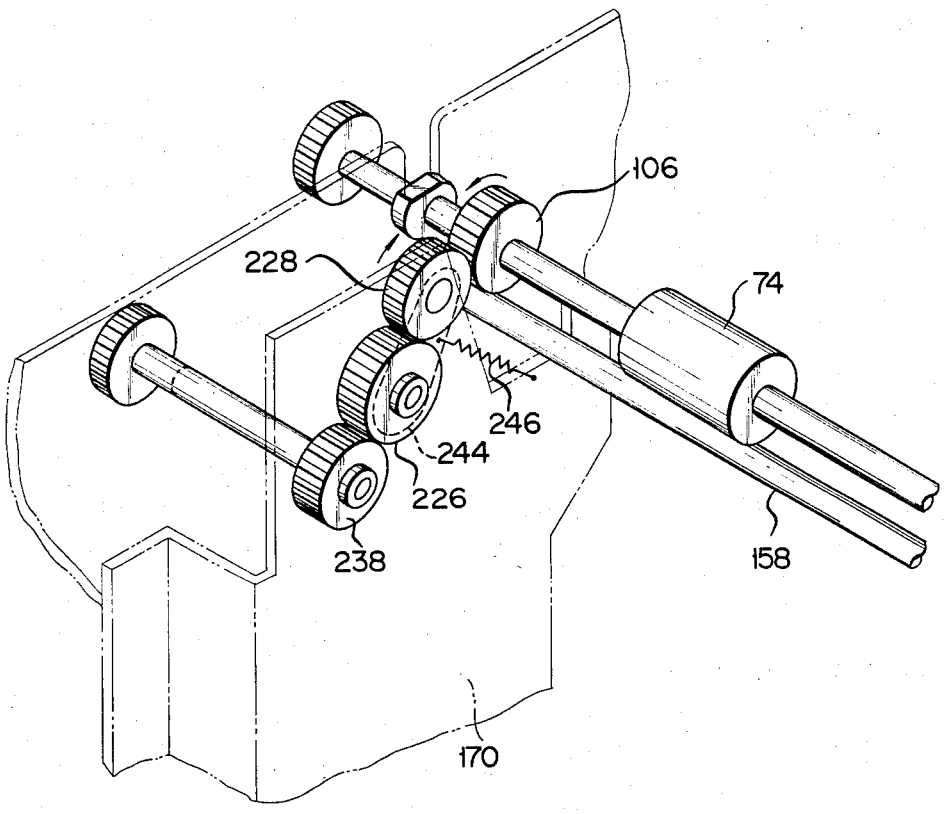
FIG. 10 is a schematic, perspective view of the power receiving unit of the sheet reverse apparatus shown in FIG. 3.
Figure 11:
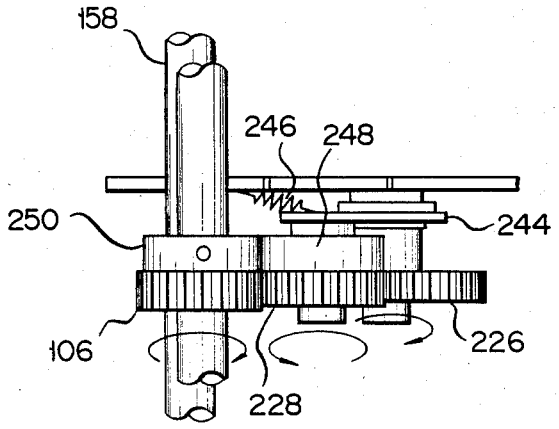
FIG. 11 is an enlarged, plan view of the main part of the power receiving unit shown in FIG. 10.

The drive transmission system 224 of the apparatus 114 will be described with reference to FIGS. 9 to 13. As described above, the apparatus 114 does not incorporate a drive source but is driven by receiving power from the output gear 106 fixed to the shaft of the roller 74. The drive transmission system 224 of the apparatus 114 is constituted by an input gear 226, a movable gear 228 pivotally and movably supported at a rotating center of the gear 226, a driving roller gear 232 for driving the roller 130, an exit roller gear 234 for driving the roller 148, and first to fourth idle gears 236, 238, 240 and 242 for transmitting the rotating force of the input gear 226 to the gear 232 or 234. As shown in FIGS. 9 and 10, the gear 226 is pivotally supported by the hook portion 168 of the member 166, and is arranged adjacent to the output gear 106 of the printer 10 when the apparatus 114 is mounted on the printer 10. The movable gear 228 is pivotally supported by one end of a swingable plate 244 which is pivotally supported at the rotating center of the gear 226. When the hook portion 168 of the member 170 is engaged with the engaging shaft 158, the gear 228 is meshed with an input gear 226. As shown in FIGS. 9 and 10, a spring 246 is arranged between the plate 244 (shown by broken line) and the member 170, and the gears 228 and 106 are meshed with each other by the biasing force of the spring 246. As shown in FIG. 11, bosses 248 and 250, having the same diameter as that of the pitch of the gears 228 and 106, are fixed to the gears 228 and 106.

Therefore, when the apparatus 114 is mounted on the printer 10, the output from the third motor (exit motor) 88 of the printer 10 is transmitted to the output gear 106, and the rotation of the gear 106 is further transmitted to the input gear 226 through the movable gear 228. The rotating force of the gear 226 is transmitted to the gears 132 and 134 through the idle gears 236, 238 and 240. In this case, since power from the printer 10 is transmitted through the gear 228, when the apparatus 114 is mounted on the printer 10, a transmission of high precision is not required to facilitate the needed reliable power transmission. That is, the movable gear 228 can be moved within a swingable range of the plate 244 while it is engaged with the gear 226. Therefore, even if the positional relationship with respect to the gear 106 of the printer 10 is shifted, the gear 228 can be securely meshed with the gear 106 within the swingable range.

The gear 228 is continuously biased toward the gear 106 by a biasing force of the spring 246 mounted on one end of the plate 244. However, excessive engagement between the gears 106 and 208 can be prevented by bringing the bosses 250 and 248 into contact with each other, and normal engagement can always be maintained on a pitch line. Therefore, friction between the gears 106 and 228 can be reduced. Since the bosses 248 and 250 abut against each other on the pitch line of the gears 228 and 106, rotational speeds of the bosses 248 and 250 coincide with those of the gears 228 and 106, and contact surfaces of the bosses 248 and 250 will not slip. Therefore, friction between the bosses 248 and 250 can be reduced.

Figure 12:
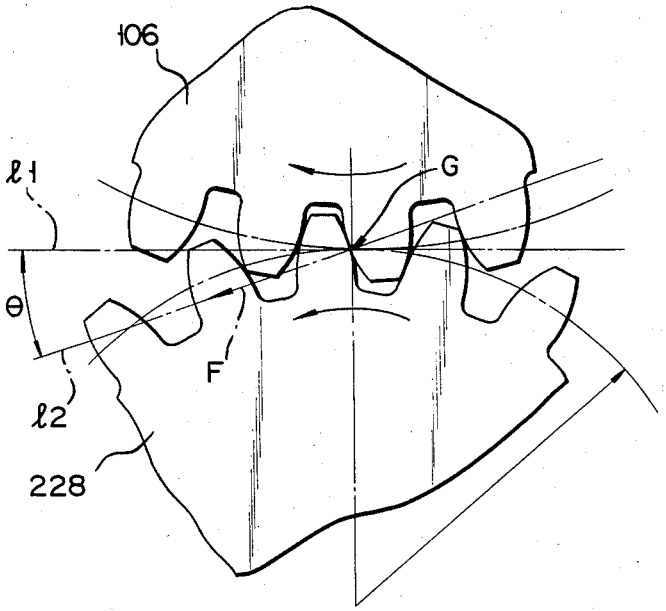
FIG. 12 is an enlarged, plan view of a part of a gear, explaining the operation of the gear.
Figure 13:
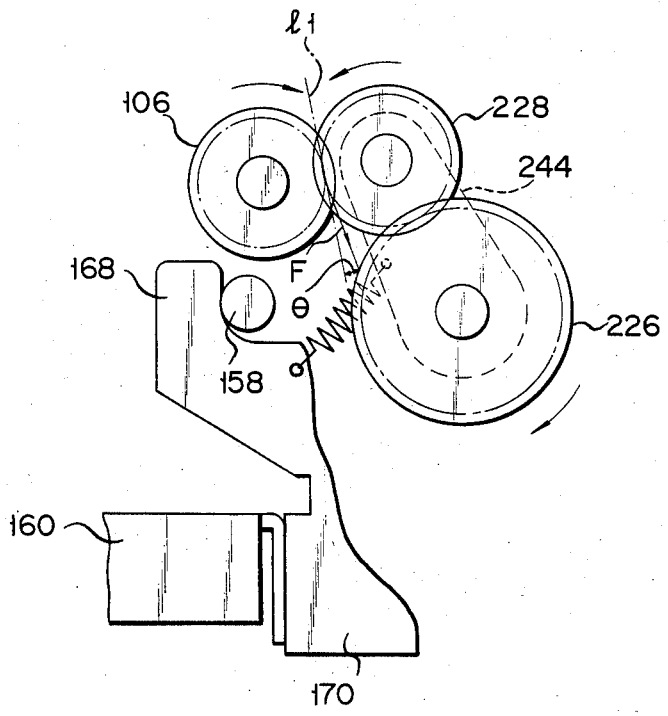
FIG. 13 is a plan view explaining the meshing state of gears in the power receiving unit.

Engagement between the gears 228 and 106 by meshing the gears 106 and 228 with each other will be explained hereinafter. FIG. 12 shows an engaged state of the gears 106 and 228. A point G is a pitch point, and a normal line passing through the pitch point G is given by l1. Although the gears 106 and 228 are meshed with each other at the point G, the compression force F of the driving gear 106 acting on the movable driven gear 228 is generated in a direction along an acting line l2 crossing the normal line l1 at an angle $\theta$ at the point G. Note that the angle $\theta$ is a pressure angle of the gears 106 and 228, and is about 20° when a standard gear is used. FIG. 13 shows the acting direction of the force F and the positional relationship between the gears 106, 228 and 226. The force F acting on the gear 228 also acts on the plate 244, and has a counterclockwise moment with respect to the center of the gear 226, which is the rotating center of the plate 244. Therefore, the plate 244 continuously receives a counterclockwise rotating force. By the counterclockwise rotating force of the plate 244, the gears 106 and 228 are continuously meshed with each other. Therefore, according to the mounting mechanism 156, the driving force from the printer 10 can be satisfactorily transmitted to the apparatus 114.

Figure 14:
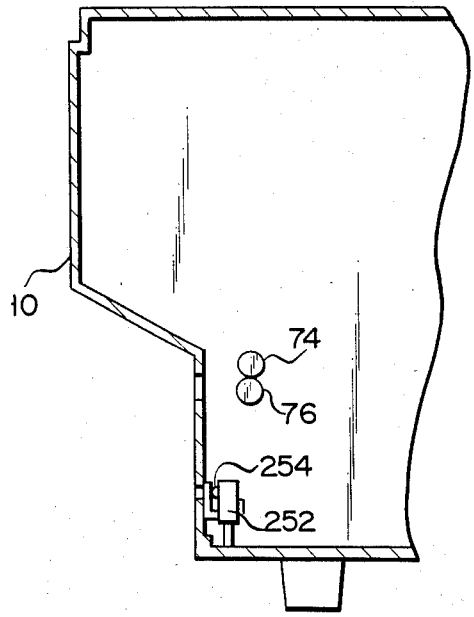
FIGS. 14 and 15 are sectional views explaining the operation for mounting the sheet reverse apparatus on the laser beam printer.
Figure 15:
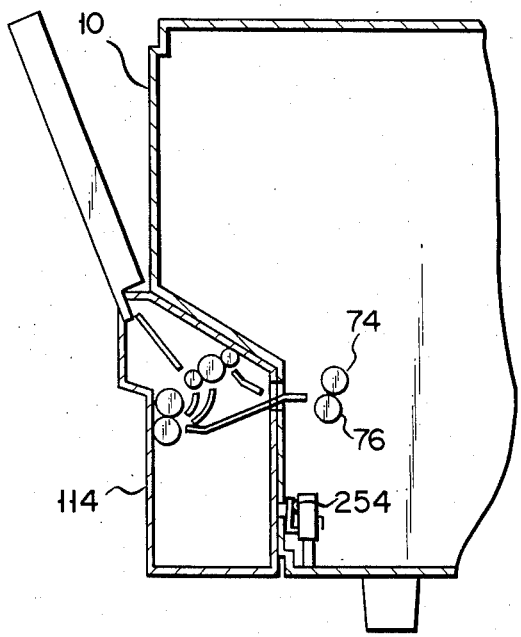

The drive control system of the printer 10 for applying a driving force to the apparatus 114 will be described with reference to FIGS. 14 to 18. As shown in FIG. 14, the printer 10 has a mount detection switch 252 as a detection means for detecting if the apparatus 114 is mounted. The switch 252 is kept OFF when the apparatus 114 is not mounted on the printer 10. However, when the apparatus 114 is mounted on the printer 10, a projection 254 is pressed by a portion 253 of the body 118 of the apparatus 114, and the switch 252 is turned ON as shown in FIG. 15. The switch 252 is connected to the third motor 88 in the printer 10 so as to control driving of a sheet exit system in the printer 10 when the apparatus 114 is mounted and demounted.

Figure 16:
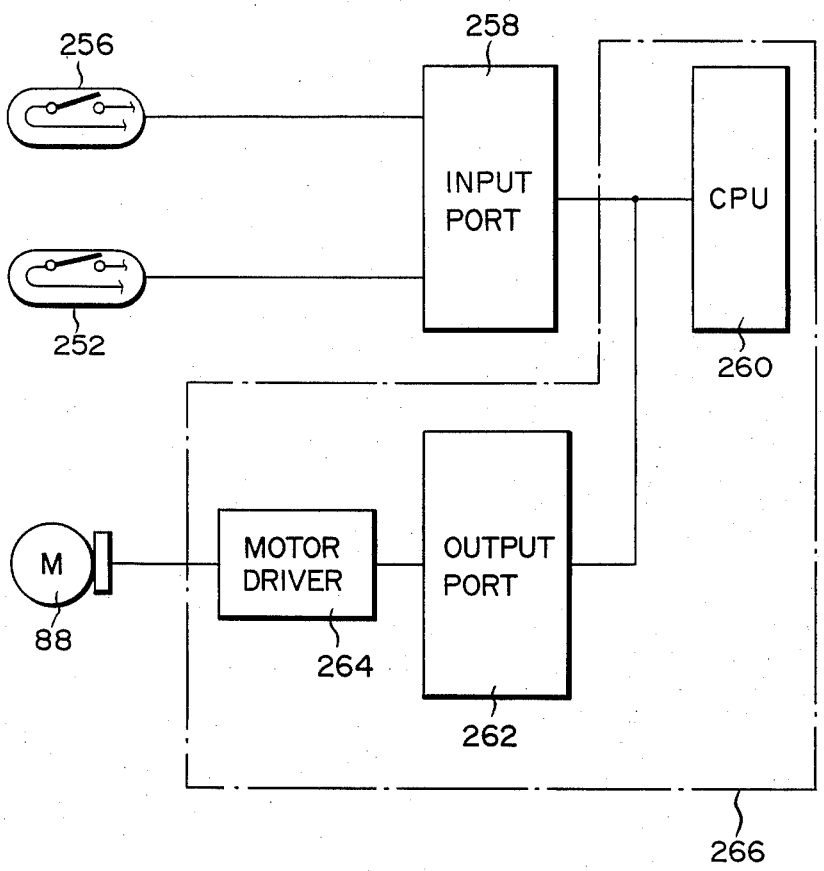
FIG. 16 is a block diagram explaining the sheet discharge operation in the printer shown in FIG. 1.

FIG. 16 is a drive control block diagram of the exit motor 88 in the printer 10. Referring to FIG. 16, reference numeral 256 denotes an exit switch which is kept ON from when the front edge of the sheet is detected between the rollers 74 and 76 and the fixing device 72, as shown in FIG. 1, until the rear edge thereof is detected. Therefore, when the switch 256 is turned ON, it is detected that the front edge of the sheet has reached the rollers 74 and 76. However, when the switch 256 is turned OFF, it is detected that the rear edge of the sheet has reached the rollers 74 and 76. The outputs from the switches 256 and 252 are supplied to a CPU 260 through an input port. The CPU 260 operates a delay timer (not shown) when the switch 256 is turned OFF (when the rear edge of the sheet is detected), and sets two timer values S (sec) and T (sec) in the delay timer based upon the presence/absence of an input from the switch 252. The relationship between the values S and T is $S<T$. when the apparatus 114 is not mounted, the timer value S is set in the timer. When the apparatus 114 is mounted, the timer value T is set in the timer. When the timer values S or T reaches 0, the CPU 260 generates a stop signal for turning OFF the motor 88. The stop signal is supplied to a motor driver 264 through an output port 262. While the driver 264 rotates the motor 88 in synchronism with the start of rotation of the photosensitive body 14, it also, upon receipt of the stop signal, stops the rotation of the motor 88. In this case, a drive control mechanism 266 is constituted of the CPU 260, the output port 262 and the driver 264.

Figure 17:
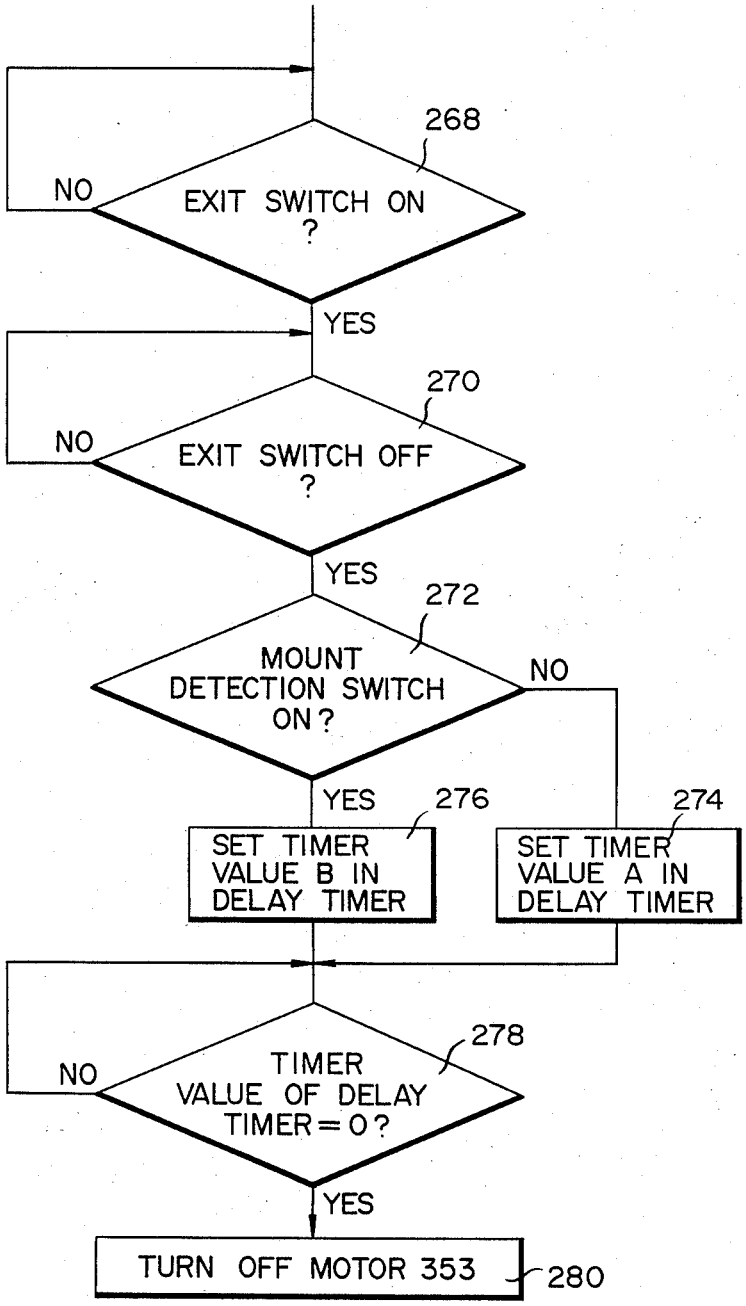
FIG. 17 is a flow chart of the operation of the CPU shown in FIG. 16.

The operation of the drive control mechanism 266 will be described with reference to FIGS. 17 and 18. FIG. 17 is a flow chart explaining the operation of the CPU 260. The CPU 260 checks in step 268 if the switch 256 is turned ON, i.e., if the front edge of the sheet has reached the rollers 74 and 76. If Y (YES) in step 268, the flow advances to step 270 where it is checked if the switch 256 is turned OFF, i.e., if the rear edge of the sheet has reached the rollers 74 and 76. Thereafter, the CPU 260 checks in step 272 if the switch 252 is turned ON, i.e., if the apparatus 114 is mounted on the printer 10. If N (NO) in step 272, the timer value S is set in the delay timer in step 274. (The timer value S refers to the time required for the sheet to be correctly stacked on the tray 152 after its rear edge passes through the rollers 74 and 76.) Therefore, when the timer value S reaches 0, since the motor 88 is stopped, i.e., the rollers 74 and 76 are stopped, the sheet on which an image is formed cna be correctly stacked on the tray 152. However, if Y in step 272, the CPU 260 sets the timer value T which is longer than the timer value S, in the delay timer in step 276. The timer value T refers to the time required for the sheet to be stacked on the tray 152 after being subjected to either the reverse or normal convey operation in the apparatus 114. When the apparatus 114 is mounted, it takes a long period of time for the sheet passing through the sheet reverse apparatus 114. In addition, since the apparatus 114 is driven by the motor 88. The timer value T is set to be longer than the timer value S. It is checked in step 278 if the timer value is 0. If Y in step 278, the flow advances to step 280. In step 280 the motor 88 is stopped. As a result, since the motor 88 is stopped at a timing when the timer value reaches 0, the sheet will not remain in the apparatus 114 but can be discharged onto the tray 152 without causing paper jam.

Figure 18:
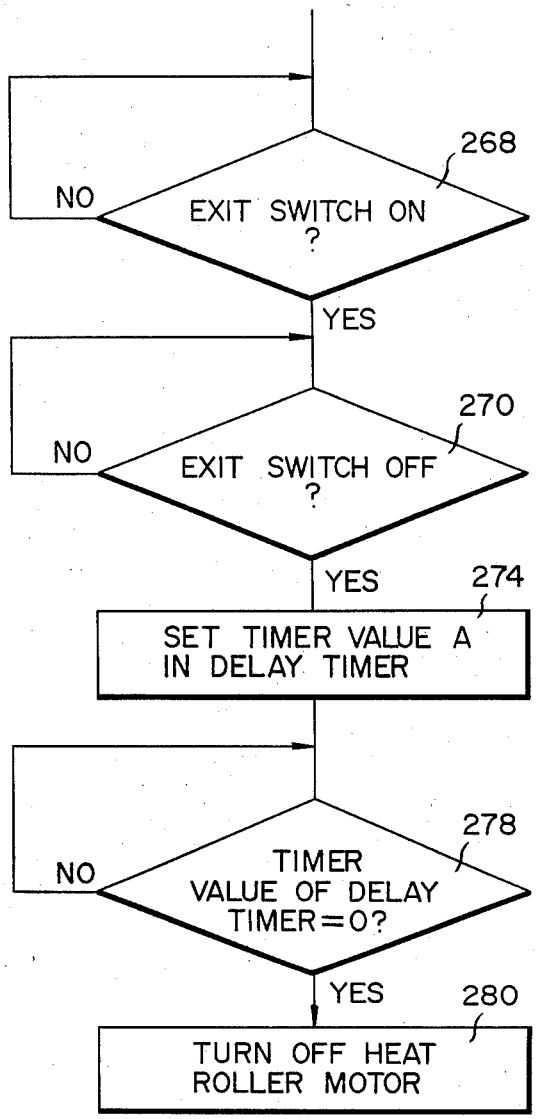
FIG. 18 is a flow chart of the operation of a CPU according to another embodiment.

As shown in the flow chart of FIG. 18, the motor 88 can be controlled only by the timer value S. In this case, steps 272 and 275 shown in FIG. 17 are omitted. When the apparatus 114 is mounted on a printer having such steps (272 and 275) and is driven by the third driving motor, if the timer value S is short the sheet feed operation may stop while the sheet is in the apparatus. Therefore, in order to prevent this possibility, the timer value S can be set longer.

Figure 20:
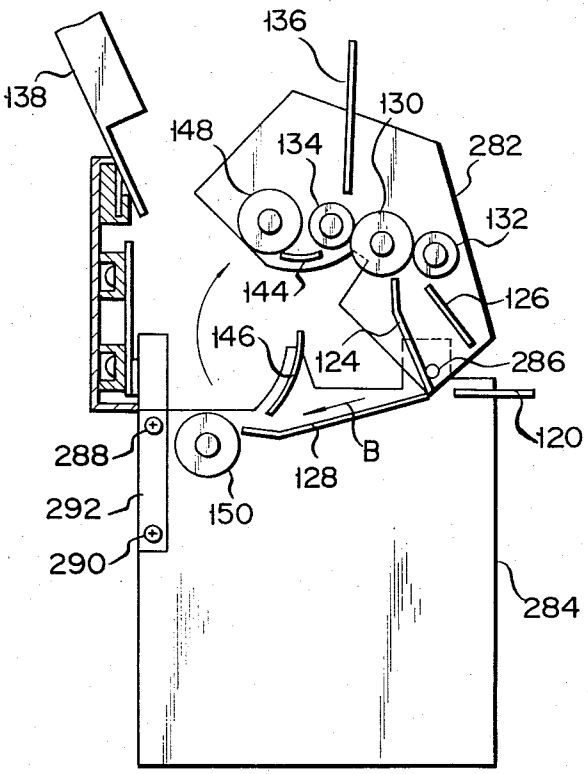
FIGS. 19 and 20 are schematic, sectional views explaining the clam shell structure of the sheet reverse apparatus shown in FIG. 3.
Figure 19:
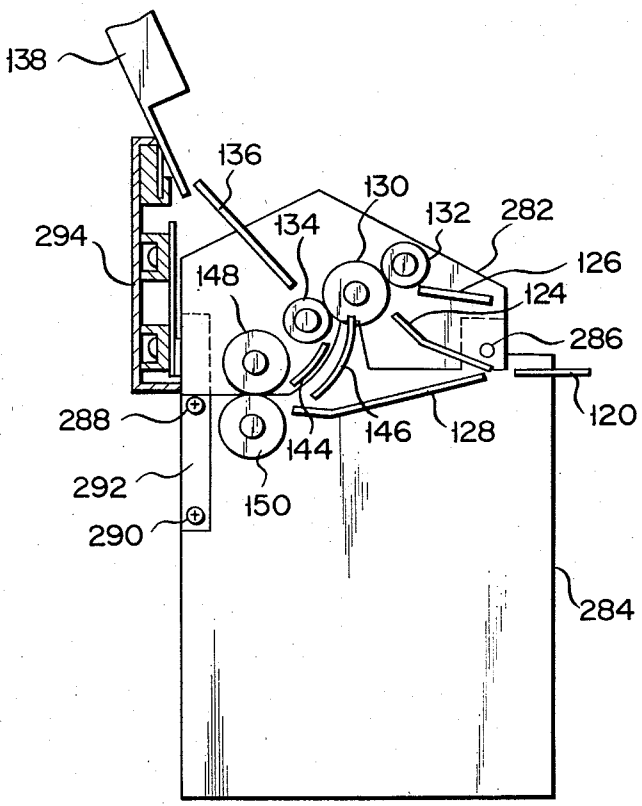

The clamshell structure for removing a jammed sheet in the apparatus 114 will be described with reference to FIGS. 19 and 20. In the apparatus 114, upper and lower frames 282 and 284 are pivotally supported through a support shaft 286 at one end portion of upper frame 282. In the upper frame 282, the second, fourth and fifth guide plates 126, 136 and 144, the gate 124, the driving roller 130, the first an second driven rollers 134 and 136, and the upper exit roller 148 are provided. Correspondingly, in the lower frame 284, the first, third and sixth guide plates 120, 128 and 146 and the lower exit roller 150 are provided. A fixing plates 292 is fixed to the frame 284 by screws 288 and 290, and a holding unit 294 for detachably holding the intermediate tray 138 is fixed to the plate 292. A portion of the edge at the pivotal side of the frame 282 is engaged with the head of the screw 288. When the frame 282 is pivoted about the shaft 286, the apparatus 114 can be opened/ closed along the second conveyor path B and a conveyor path from the rollers 130 and 134 to the rollers 148 and 150 (clamshell structure). According to this embodiment, since the apparatus 114 has a clamshell structure, when paper jam occurs along the path B or between the fifth and sixth guides 144 and 146, the frame 282 can be opened by pivoting it, and the jammed paper can be removed from the conveyor path. According to this embodiment, paper jam can be easily prevented by the above-mentioned simple structure, thus allowing easy maintenance.

Figure 21:
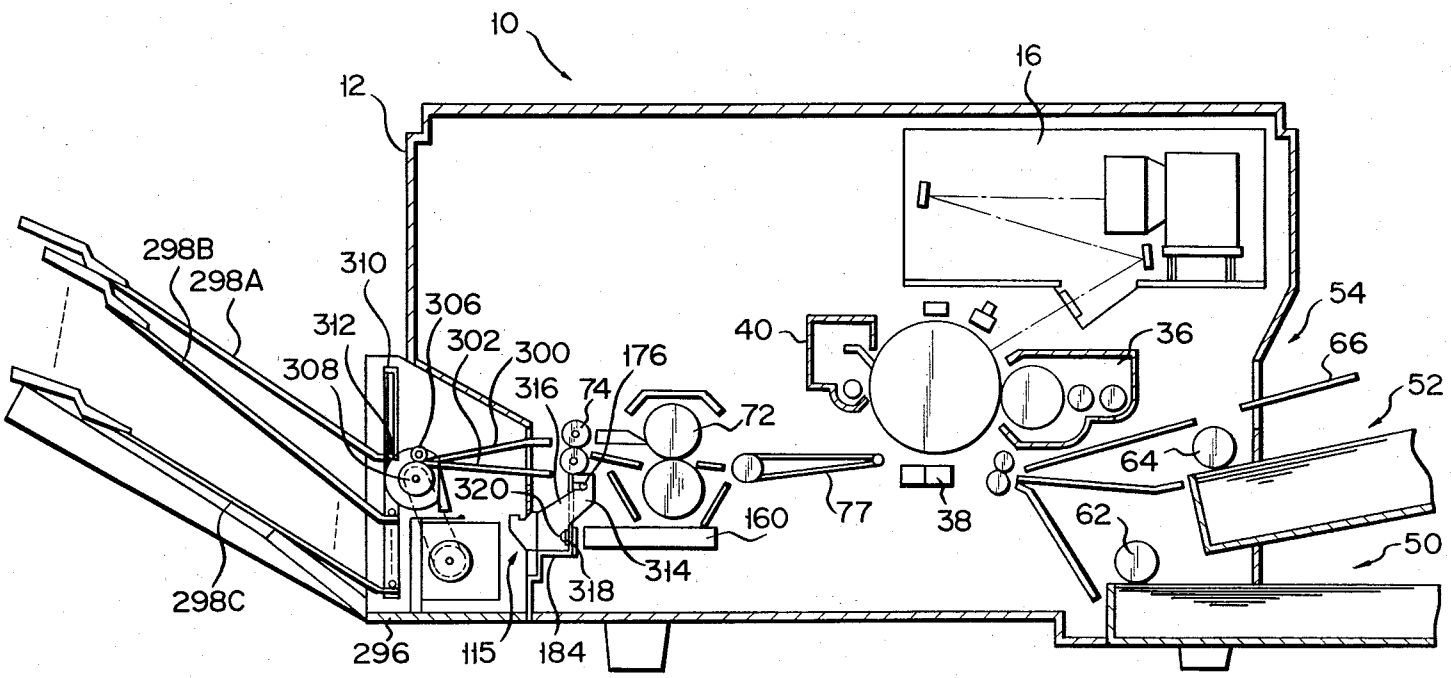
FIG. 21 is a schematic, sectional view of the state wherein a sorter is mounted on the printer.
Figure 22:
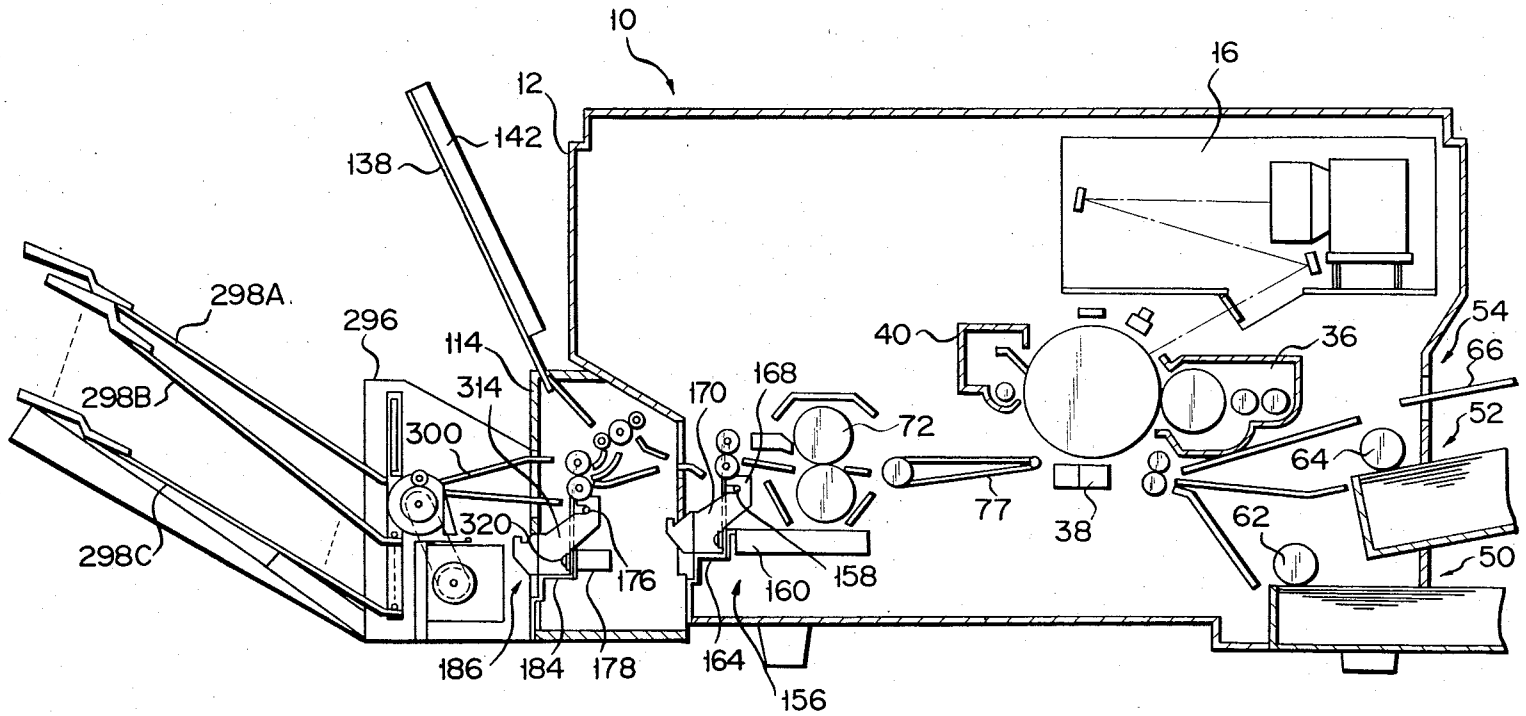
FIG. 22 is a schematic, sectional view of the state wherein the sheet reverse apparatus shown in FIG. 3 is mounted on the laser beam printer shown in FIG. 1.

An optional device which can be detachably mounted at each exit side of the printer 10 and the apparatus 114 will be described with reference to FIGS. 3, 21 and 22. As shown in FIG. 3, the mounting mechanism 156 of the printer 10 and the mounting unit 186 of the apparatus 114 have the same configuration, comprising the engaging shafts 158 and 176 and the horizontal surfaces 164 and 184. That is, referring to FIG. 3, the apparatus 114 and the tray 152 can be selectively mounted on the printer 10 by the same mounting method. In this embodiment, as shown in FIG. 21, a sorter 296, as an optional device, can be mounted on the printer 10 in place of the tray 152 by the same mounting method. Alternatively, as shown in FIG. 21, the sorter 296 can be loaded to the exit side of the apparatus 114.

The sorter 296 is a device for classifying copies of a given number of sheets so as to stack them on a plurality of trays 298A, 298B, 298C, . . . In the sorter 296, upper and lower guide plates 300 and 302 for guiding the sheets discharged from the exit rollers 74 and 76 of the printer 10 and exit rollers 306 and 308 are provided. The sheets fed from the rollers 306 and 308 are classified and stacked onto the trays 298A, 298B, 298C, . . . For the trays 298A, 298B, 298C, . . . , a slider 312 is slidably arranged within a vertically extending guide frame 310. The slider 312 is guided by a grooved portion of a cylindrical cam (not shown) rotated on the frame 310 so as to move the trays 298A, 298B, 298C, . . . upward in accordance with the number of copies. The mounting unit 315 of the sorter 296 has the same configuration as the mounting unit 156 of the apparatus 114, and comprises a mounting metal member 316 formed by extending a hook portion 314 obliquely upward. The sorter 296 can be mounted on the printer 10 in the same manner as the apparatus 114. That is, as shown in FIG. 21, the hook portion 314 of the member 316 is inserted obliquely upward with respect to the engaging shaft 176 of the printer 10, and the portion 314 is engaged with the shaft 176. The sorter 296 is rotated counterclockwise about the shaft 176 by its weight so that the lower end of the member 316 abuts against the horizontal surface 184. In this manner, the sorter 296 can be mounted on the printer 10 in basically the same manner as in the case wherein the apparatus 114 and the tray 152 are mounted, with the member 316 being engaged by the shaft 176 and the surface 184. In this case, in order to further tightly fix the sorter as in the apparatus 114, bent portions 318 are formed by extending the two ends of the member 316, which are then fixed to the frame 160 of the printer 10 by screws 320. when the sorter 296 is mounted on the printer 10, the sheets fed from the printer 10 while each image surface faces upward can be sorted and stacked by a given number of copies.

The apparatus 114 comprises the mounting unit 186 having the same configuration as the mechanism 156 of the printer 10. Therefore, as shown in FIG. 22, the sorter 296 can be fixed to the unit 186 of the apparatus 114 in the same manner as the sorter 296. In this manner, when the apparatus 114 and the sorter 296 are coupled to each other and fixed to the exit side of the printer 10, the sheets whose image surfaces face downward can be automatically sorted and stacked, thus considerably reducing the time required to complete the entire operation by eliminating the need for a manual stacking procedure.

As described above, according to this embodiment, the apparatus 114, the tray 152 (shown in FIG. 3) and the sorter 296 can be seletively and detachably mounted at the exit side of the printer 10, and the tray 152 and the sorter 296 can be selectively mounted at the conveyor side of the apparatus 114. Furthermore, since each optional device (the sorter 296, the tray 152 or the apparatus 114) can be mounted by the same method, a special-purpose adapter is not required, and the mounting-/demounting operation can be easily and quickly performed.

Note that the present invention is not limited to the above embodiment, and that various changes and modifications may be made within the spirit and scope of the invention.

In the above embodiment, the apparatus 114 receives driving power from the motor 88 to drive the rollers 72, 74 and 76. However, the drive source is not limited to this. Any drive source in the image forming apparatus 10, e.g., the first motor 90 for driving the photosensitive body can be used as the drive source. The output gear 106 is not limited to the gear 116 coaxial with the roller 74 but can be any other gear driven by the drive source.

What is claimed is:

1. A sheet reverse apparatus for reversing the image surface of a sheet discharged from an image forming apparatus having an output gear of a drive system, comprising:

mounting means for mounting said sheet reverse apparatus to said image forming apparatus;

an input gear for receiving driving power;

driving force transmission means which meshes with said output gear when said sheet reverse apparatus is mounted to said image forming apparatus to transmit a rotational force from said output gear to said input gear, said driving force transmission means having one end pivotally supported at a rotating center of said input gear and including a swingable plate swingable around the rotating center, and the driving force transmission means itself serving to pivotally support, at its other end, a movable gear which is meshed with and rotatable around said input gear; and spring means for biasing said swingable plate toward said output gear so as to mesh said movable gear with said output gear.

2. An apparatus according to claim 1, wherein said output gear and said movable gear have bosses which contact each other on pitch lines thereof.

3. An apparatus according to claim 1, wherein said spring means has one end fixed to a portion of said swingable plate and the other end fixed to a portion of said mounting means.

4. An apparatus according to claim 1, wherein said movable gear is rotated in a direction for rotating said input gear along a direction of a biasing force of said spring means, whereby when said output gear and said movable gear are meshed with each other, the direction of a compression force generated by the rotataional forces thereof acts in the direction of the biasing force of said spring means.

5. An apparatus according to claim 1, wherein said output gear is coaxial with the shafts of exit rollers arranged in said image forming apparatus.

6. An apparatus according to claim 1, wherein said image forming apparatus has a switch which is turned on when said sheet reverse apparatus is mounted on the image forming apparatus, and, upon operation of said switch, a control operation of the drive system of said image forming apparatus is switched on and a drive time is set to be longer than a time required for the paper sheet to pass through said sheet reverse apparatus.

7. An apparatus according to claim 6, wherein said switch has an abutment which is depressed by a projection formed on said sheet reverse apparatus.

8. An apparatus according to claim 1, wherein said sheet reverse apparatus has a shell-shaped mechanism which is disposed along a conveyor path of the paper sheet.

9. An apparatus according to claim 1, wherein said mounting means has an engaging shaft formed on said image forming apparatus, and a mounting metal member having one end provided with a hook which can be engaged with said engaging shaft, and another end which can be engaged with said sheet reverse apparatus.

10. An apparatus according to claim 9, wherein said mounting means of said image forming apparatus has a stepped portion which has a horizontal surface and is formed into a step-shape, and the other end of said mounting metal member is formed into a shape corresponding to that of said stepped portion, and engaged with said stepped portion when said sheet reverse apparatus is mounted on said image forming apparatus.

11. An apparatus according to claim 10, wherein said mounting metal member has a bent portion for fixing said mounting metal member to said stepped portion of said image forming apparatus by means of a screw.

12. An apparatus according to claim 1, wherein said sheet reverse apparatus has a first conveyor path for reversing the image surface of the paper sheet, and a second conveyor path for conveying the paper sheet without reversing the image surface.

13. An apparatus according to claim 12, wherein said sheet reverse apparatus has a gate for selectively guiding the paper sheet conveyed thereto into one of said first and second conveyor paths.

14. An apparatus according to claim 1, wherein said sheet reverse apparatus has an intermediate tray for reversing the paper sheet midway along a conveyor path in such a manner that the paper sheet is temporarily stored in said intermediate tray with its front edge forward, and discharged from the tray with its rear edge leading.

15. An apparatus according to claim 14, wherein said intermediate tray is covered with a transparent cover so that the image surface of the paper sheet stored in said intermediate tray can be observed.

16. An apparatus according to claim 14, wherein a flexible guide plate for guiding the paper sheet to said intermediate tray is arranged in said sheet reverse apparatus, one end of said guide plate is a fixed end and the other end thereof is a free end, the paper sheet is conveyed in a direction for pushing up the free end by means of its rear edge, and said guide plate restricts an insertion angle of the paper sheet with respect to said intermediate tray.

* * * * *